US009434171B2

(12) United States Patent
Yamada et al.

(10) Patent No.: US 9,434,171 B2
(45) Date of Patent: Sep. 6, 2016

(54) INK CARTRIDGE AND INKJET PRINTER

(71) Applicant: Seiko Epson Corporation, Tokyo (JP)

(72) Inventors: Manabu Yamada, Matsumoto (JP); Toshio Arimura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/989,018

(22) Filed: Jan. 6, 2016

(65) Prior Publication Data

US 2016/0200112 A1 Jul. 14, 2016

(30) Foreign Application Priority Data

Jan. 8, 2015 (JP) ..... 2015-002086
Feb. 18, 2015 (JP) ..... 2015-029308

(51) Int. Cl.
*B41J 2/165* (2006.01)
*B41J 2/175* (2006.01)

(52) U.S. Cl.
CPC ..... *B41J 2/17513* (2013.01); *B41J 2/17596* (2013.01)

(58) Field of Classification Search
None
See application file for complete search history.

(56) References Cited

U.S. PATENT DOCUMENTS 7,052,121 B2 5/2006 Yamada
7,341,335 B2 3/2008 Akahane et al.
2004/0165044 A1* 8/2004 Yamada ..... B41J 2/17513 347/86

FOREIGN PATENT DOCUMENTS

JP 2004-074599 A 3/2004
JP 2006-116946 A 5/2006
JP 2006-123562 A 5/2006

* cited by examiner

*Primary Examiner* — Alejandro Valencia

(57) ABSTRACT

An ink cartridge prevents ink from leaking from a waste ink recovery chamber, and an inkjet printer in which ink does not leak from the ink supply needle of the ink cartridge holder. The ink cartridge 10 has an ink chamber 30 and a waste ink inlet 57 in the top of the ink cartridge 30. Ink overflowing the capacity of the waste ink recovery chamber 20 flows through an ink trap 22 and into the ink cartridge 30 from the waste ink inlet 57. The ink supply needle 7 of the inkjet printer 1 has an ink path 73, valve member 90, and coil spring 74. The valve member 90 moves between a closed position 90A and a open position 90B according to whether or not an ink cartridge 10 is installed, and prevents ink from leaking from the ink supply needle 7.

14 Claims, 10 Drawing Sheets

INK CARTRIDGE AND INKJET PRINTER

BACKGROUND

1. Technical Field

The present disclosure relates to an ink cartridge and to an inkjet printer having an ink supply needle disposed to a cartridge holder in which the ink cartridge is installed.

2. Related Art

An inkjet printer has a cartridge holder in which an ink cartridge that stores ink is removably installed. An ink supply needle that connects to the ink supply opening is disposed to the cartridge holder. When an ink cartridge is not installed in the cartridge holder, the ink supply needle is exposed inside the cartridge holder. An ink path that communicates with the inkjet head is formed inside the ink supply needle, and an opening formed as a round hole that communicates with the ink path is formed in the distal end of the ink supply needle.

Inkjet printers of this type perform a cleaning operation that forcibly ejects or suctions ink from inside the ink nozzles in order to prevent or remove clogs in the ink nozzles that eject the ink to print. The ink ejected or suctioned in the cleaning operation is recovered through a cap that covers the nozzle face into a waste ink recovery unit. Ink cartridges used in such inkjet printers typically have a waste ink recovery chamber to hold the unused ink inside the ink cartridge. An ink cartridge of this type is described in JP-A-2004-74599.

Inkjet printers of this type may also be shipped for repair, for example, without the ink cartridge installed (after removing the ink cartridge). In this event, if the cartridge holder is tilted or vibrates, the ink meniscus formed in the opening at the distal end of the ink supply needle may break, and ink left inside the ink path may leak from the opening in the ink supply needle. As a result, the inside of the inkjet printer may become soiled by ink, and the user's hands may become soiled with ink when replacing the ink cartridge. Furthermore, if ink gets onto the circuit board disposed inside the inkjet printer, the inkjet printer may become unusable (inoperable).

JP-A-2006-116946 discloses a configuration placing a valve seal in the ink path to prevent ink from leaking from the ink supply needle in this type of inkjet printer. The valve seal of JP-A-2006-116946 is disposed in a valve chamber at the base end of the ink supply needle. When fluid pressure sufficient to supply ink to the ink path inside the ink supply needle is applied through the valve chamber, the valve seal closes the ink path.

To discharge ink that has increased in viscosity inside the ink nozzles, this type of inkjet printer performs a powerful cleaning operation sufficient to completely replace the ink in the ink path of the inkjet head. When this cleaning operation is performed, a large amount of ink flows at one time into the waste ink recovery chamber. Ink may therefore overflow from the waste ink recovery chamber if this powerful cleaning operation is repeated when the capacity of the waste ink recovery chamber is low and a large amount of waste ink has previously been recovered into the waste ink recovery chamber. When ink overflows from the waste ink recovery chamber, the inside of the inkjet printer becomes soiled by ink and the user's hands may be soiled by ink when replacing the ink cartridge. Furthermore, if ink gets on the circuit board inside the inkjet printer, the inkjet printer may become inoperable.

As a result, when ink leaks from the waste ink recovery chamber, the cleaning operation cannot be performed and the ink cartridge must be replaced. To avoid replacing the ink cartridge because of insufficient capacity left in the waste ink recovery chamber even though unused ink remains in the ink cartridge, the capacity of the waste ink recovery chamber must be increased. However, increasing the capacity of the waste ink recovery chamber makes the ink cartridge larger. As a result, the inkjet printer also becomes larger.

When replacing the ink cartridge because of insufficient capacity in the waste ink recovery chamber, the ink cartridge may be replaced with ink left in the ink chamber, and the unused ink is thus unused and wasted.

With the configuration of the inkjet printer described in JP-A-2006-116946, the valve seal that closes the ink path floats inside the valve chamber, and the valve seal opens and closes the ink path created by the operation of a control valve disposed between the valve seal and the inkjet head. A control valve must therefore be disposed behind the valve seal, the fluid pressure must be controlled when opening and closing, and both construction and control are complicated.

SUMMARY

According to some embodiments, an ink cartridge has a case with an air vent; and a divider dividing at least part of the space inside the case into an ink chamber and a waste ink recovery chamber. The dividers has a waste ink inlet connecting the ink chamber and the waste ink recovery chamber, and an air passage connecting the waste ink inlet to the air vent through the ink chamber.

A waste ink connects the ink cartridge to the waste ink recovery chamber. The waste ink inlet also connects to the outside air vent through the ink cartridge. As a result, ink overflowing the capacity of the waste ink recovery chamber can flow from the waste ink inlet into the ink cartridge. Needing to replace the ink cartridge because there is insufficient capacity in the waste ink recovery chamber before all ink in the ink chambers has been used can therefore be prevented. The ink in the ink chambers can therefore be used completely without waste. Furthermore, because the recovered waste ink can be re-used, ink waste is minimal. Increasing the size of the ink cartridge can also be avoided because there is no need to increase the capacity of the waste ink recovery chamber to avoid replacing the ink cartridge due to insufficient capacity in the waste ink recovery chamber.

In some embodiments, the divider divides part of the space inside the case vertically; the ink chamber is located below the divider; the waste ink recovery chamber has a waste ink inflow space above the divider, and a waste ink chamber located beside the ink chamber; and the top of the waste ink chamber is connected to the waste ink inflow space.

Thus comprised, ink overflowing from the waste ink chamber flows through the waste ink inflow space into the ink cartridge from the top. Because the waste ink chamber and the ink cartridge are beside each other, the waste ink inlet through which waste ink from the outside can be disposed beside the ink supply unit that supplies ink from the ink chamber to the outside.

In some embodiments, the case has a plurality of ink chambers. In this case, the divider has plural cap members configured to cap the tops of the plural ink chambers; the waste ink inlet is formed in one of the cap members; and the air passage includes an ink chamber communication path connecting adjacent ink chambers, and an air vent communication passage connecting one of the plural ink chambers to the air vent.

Thus comprised, even if waste ink leaks from one ink chamber, the waste ink flows through the ink chamber communication path to another ink chamber, and needing to replace the ink cartridge because there is insufficient capacity left in the waste ink recovery chamber can be avoided.

In some embodiments, the plural ink chambers and the plural cap members are arranged in a row; the air vent communication passage connects the ink chamber at one end of the row and the air vent; and the waste ink inlet is formed in the cap member configured to cap the top of the ink cartridge at the other end of the row.

Thus comprised, waste ink flows first into the ink chamber that is farthest from the air vent, and then overflows sequentially into the ink chamber next closest to the air vent. Finally, waste ink flows into the ink chamber that is closest to the air vent. Waste ink can therefore be transferred to all of the ink chambers as a result of ink flowing in one direction, and air and waste ink can move smoothly through the ink chamber communication path.

According to some embodiments, an ink cartridge also has a bottom flow channel connecting the bottom parts of adjacent ink cartridges.

Because the internal pressure of the plural ink chambers differs because of the different amount of ink in each, ink moves between the ink chambers due to the pressure differential. An equal amount of ink can therefore be maintained in the ink chambers.

In some embodiments, an ink cartridge also has a movable cover configured to divide the ink cartridge into an ink chamber head space and an ink holding chamber therebelow; and a pressure member configured to push the movable cover to the ink chamber head space side with less force than the surface tension of the ink meniscus formed between the inside circumference surface of the ink chamber and the outside circumference surface of the movable cover.

Thus comprised, ink does not flow above the movable cap when waste ink does not flow into the ink chamber head space because the ink meniscus formed around the outside surface of the movable cover does not break, but when waste ink flows into the ink chamber head space, the ink meniscus is broken by the waste ink and waste ink flows into the ink holding chamber below the movable cover. Waste ink can therefore be recovered into the ink holding chamber and reused, and the amount of ink that is wasted can be reduced.

In some embodiments, the case includes a case body in which the ink chamber and waste ink recovery chamber are formed, and a cover member configured to close the opening to the case body and having the air vent formed therein; and the air passage has a bubble trap connected to the air vent, and a channel connecting the bubble trap to the outside. For example, an opening may be formed in the bottom of the bubble trap; the divider have a tubular protrusion protruding into the opening in the bubble trap; and the air vent communicate with the bubble trap through the inside of the tubular protrusion.

Thus comprised, bubbles that enter the ink chamber with waste ink pass through the air path into the bubble trap, and the bubbles pop and disappear inside the bubble trap. Bubbles passing through the channel to the outside, popping as soon as they reach the outside, and soiling the case with ink can therefore be prevented.

Some embodiments include an inkjet printer that has a printhead; and a cartridge holder in which an ink cartridge configured to supply ink to the printhead is installed, and which has an ink supply needle in which an ink path is formed; the ink supply needle having a valve member with a stem disposed in the ink path, and a seal member configured to open and close the ink path, and a first urging member configured to urge the valve member toward the distal end of the ink supply needle; wherein the valve member moves between a closed position where the seal member closes the ink path and the stem protrudes from the opening in the distal end of the ink supply needle, and an open position where the ink path is not closed by the seal member.

Thus comprised, a valve member with a seal member and a stem is installed inside the ink supply needle disposed to the cartridge holder, and the stem protrudes from the opening formed in the distal end of the ink supply needle when the ink path through the ink supply needle is closed by the seal member. When the ink cartridge is not installed, the valve member is set to the closed position by a first urging member, and the ink path remains sealed by the seal member. When an ink cartridge is installed, the stem is pushed by a construction on the ink cartridge side, and the valve member can be moved to the open position where the seal member does not close the ink path. The ink path can therefore be reliably sealed closed when an ink cartridge is not installed without using a control valve or other means of driving the valve member. Ink leaking from the ink supply needle can therefore be reliably prevented.

In some embodiments, the stem does not protrude from the opening in the open position.

If the stem is pushed into the ink path, a valving element disposed int the ink supply opening on the ink cartridge side can be pushed by the ink supply needle, and the ink supply needle can be pushed into the ink supply opening similarly to a conventional ink supply needle.

In some embodiments, the stem is pushed by the valving element closing the ink supply opening of the ink cartridge, the valve member moves to the open position, and the ink supply needle is then inserted to the ink supply opening when the ink cartridge is installed in the cartridge holder; and when the ink cartridge is removed from the cartridge holder, the ink supply needle is pulled out from the ink supply opening, the valving element returns to the position closing the ink supply opening, and the valve member then returns to the closed position by the urging force of the first urging member.

Thus comprised, when the valve on the ink supply needle side opens and the connection between the ink supply needle and the ink supply opening is sealed by the seal member in the ink supply opening, the valve on the ink cartridge side opens. Ink from inside the ink cartridge can therefore be prevented from leaking when the ink supply needle and the ink supply opening connect.

For example, the first urging member urges the valve member with less urging force than the urging force of a second urging member configured to urge the valving element to the side closing the ink supply opening. In addition, the urging direction of the valve member by the first urging member is opposite the urging direction of the valving element by the second urging member.

Thus comprised, because the urging force of the second urging member that pushes the stem protruding from the ink supply needle into the opening is greater than the urging force of the first urging member that pushes the valving element into the ink supply opening, only the stem portion is pushed into the ink supply opening before the valve on the ink supply needle side opens. Therefore, the connection between the ink supply needle and the ink supply opening is always sealed, and the valve on the ink supply needle side is reliably opened, when the valve on the ink cartridge side opens.

In some embodiments, the ink supply needle has a tubular part in which the ink path is formed, and a through-hole passing through the tubular part.

Thus comprised, even if the opening in the distal end of the ink supply needle is closed when it meets the valving element, the ink path communicates with the outside through the through-hole at a different position than the opening in the distal end. The ink path on the ink supply needle side being blocked by the valving element on the ink cartridge side can therefore be avoided.

In some embodiments, the ink supply needle has a channel extending from the edge of the opening to the outside circumference side.

Thus comprised, even when the opening in the distal end of the ink supply needle is touching the valving element, the ink path communicates with the outside through the channel extending from the edge of the opening. The ink path on the ink supply needle side being blocked by the valving element on the ink cartridge side can therefore be avoided.

In some embodiments, a flow path extending axially to the stem is formed in the outside circumference surface of the stem.

Thus comprised, a space for ink to flow can be assured inside the flow path when the valve member is installed with the stem sliding against the inside wall around the ink path inside the ink supply needle. Skewing of the valve member inside the ink supply needle can therefore be suppressed while assuring a path for ink to flow through.

DESCRIPTION OF EMBODIMENTS

Exemplary embodiments of an ink cartridge 10 and an inkjet printer 1 that prints with the ink cartridge 10 according to the present disclosure are described below with reference to the accompanying drawings.

General Configuration

Figure 1:
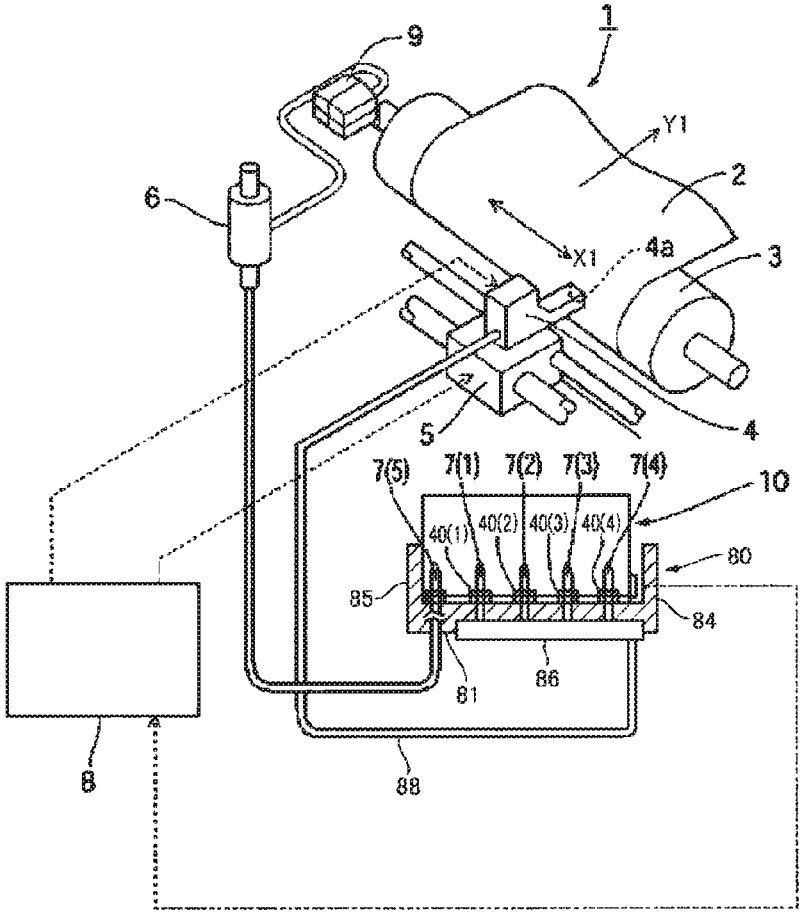
FIG. 1 schematically illustrates an inkjet printer according to at least one embodiment.

FIG. 1 schematically describes an inkjet printer 1 according to in accordance with one or more embodiments. This inkjet printer 1 has a platen 3 configured to convey recording paper 2; an inkjet head 4 (printhead) disposed with the nozzle face opposite the platen 3; a carriage 5 that carries and moves the inkjet head 4 bidirectionally in the direction of travel X1 perpendicular to the conveyance direction Y1 of the recording paper 2; a cartridge holder 80; and a drive control unit 8 that controls parts of the inkjet printer 1. An ink cartridge 10 that supplies ink to the ink nozzles of the inkjet head 4 is installed to the cartridge holder 80.

As described further below, the ink cartridge 10 has four ink chambers 30(1) to 30(4), and one waste ink recovery chamber 20 (see FIG. 3) for recovering waste ink. The cartridge holder 80 also has four ink supply needles 7(1) to 7(4) for extracting ink from the ink chambers 30(1) to 30(4), and an ink recovery needle 7(5) for discharging waste ink into the waste ink recovery chamber 20. Installing an ink cartridge 10 to the cartridge holder 80 completes the ink supply path for supplying ink from the ink cartridge 10 to the inkjet head 4.

The inkjet printer 1 also has a nozzle cap 9 disposed to a position offset from the platen 3 in the direction of travel X1 of the carriage 5. The nozzle cap 9 is connected to the ink recovery needle 7(5) through the ink pump 6. Therefore, when the ink cartridge 10 is installed to the cartridge holder 80, an ink recovery path is completed from the nozzle cap 9, through the ink recovery needle 7(5), to the waste ink recovery chamber 20 inside the ink cartridge 10. When the ink pump 6 is driven with the nozzle face 4*a* of the inkjet head 4 covered by the nozzle cap 9, waste ink can be recovered into the waste ink recovery chamber 20.

Ink Cartridge

Figure 2A:
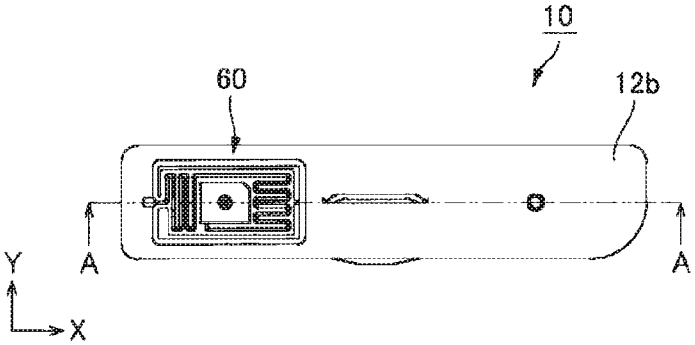
FIG. 2A is a plan view of an ink cartridge according to at least one embodiment.
Figure 2B:
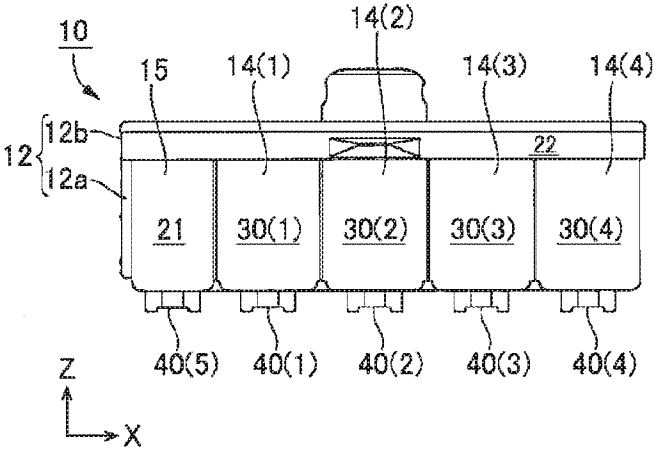
FIG. 2B is a front view of an ink cartridge according to at least one embodiment.
Figure 2C:
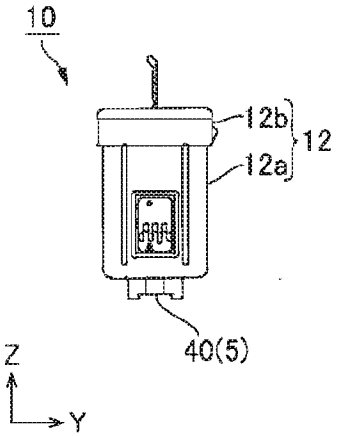
FIG. 2C is a left side view of an ink cartridge according to at least one embodiment.
Figure 2D:
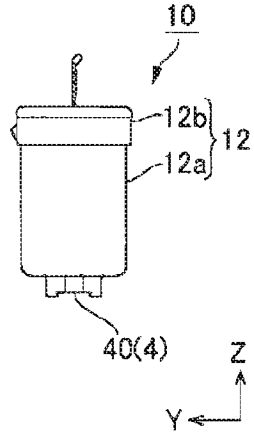
FIG. 2D is a right side view of an ink cartridge according to at least one embodiment.
Figure 3:
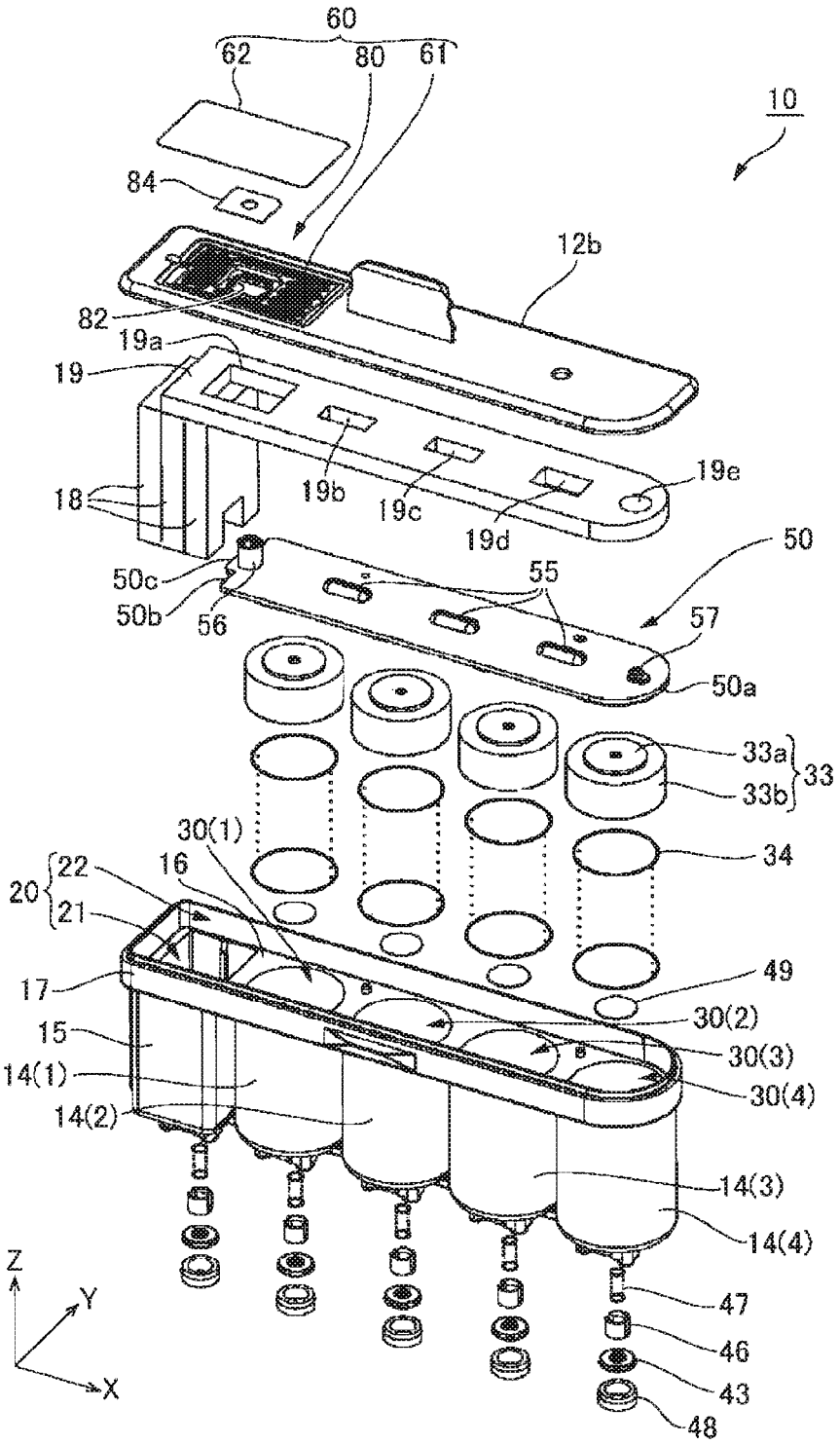
FIG. 3 is an exploded oblique view of the ink cartridge in FIG. 2.
Figure 4A:
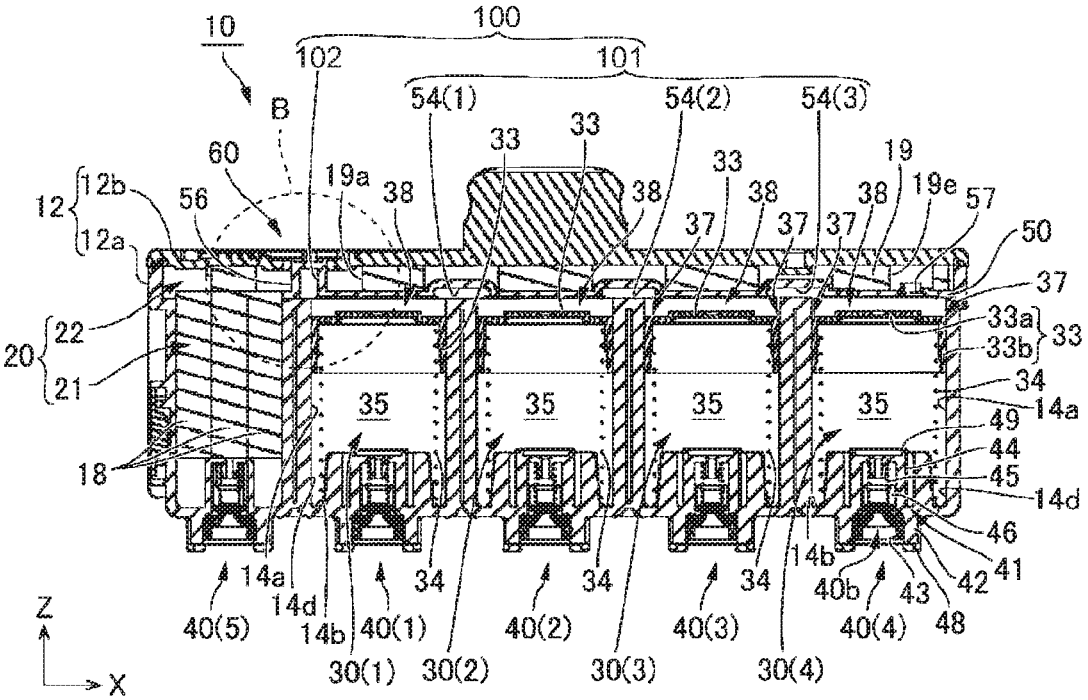
FIG. 4A is section view of the ink cartridge in FIG. 2.
Figure 4B:
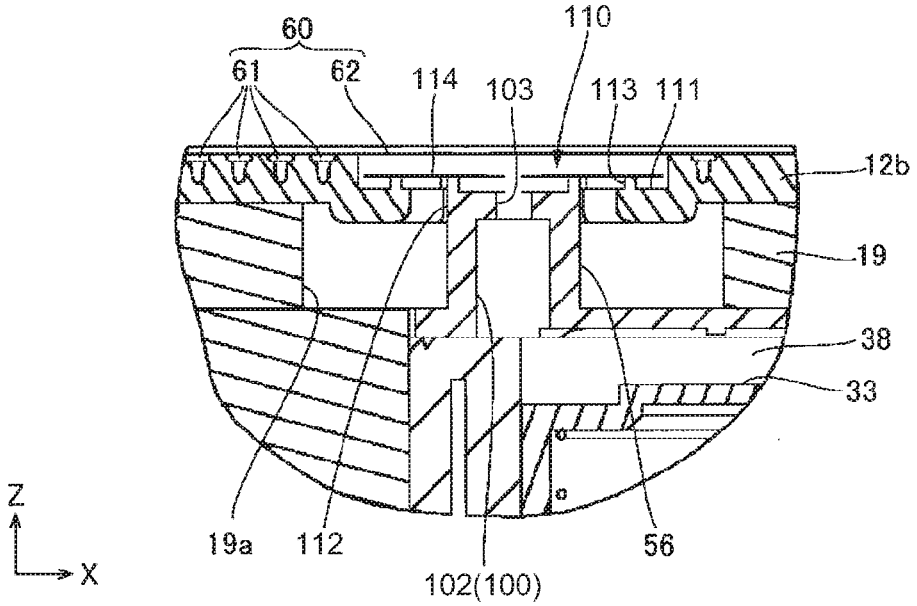
FIG. 4B is an enlarged view of part of FIG. 4A.

FIG. 2A to FIG. 2D show the ink cartridge 10. FIG. 2A is a plan view, FIG. 2B is a front view, FIG. 2C is a left side view, and FIG. 2D is a right side view of the ink cartridge 10. FIG. 3 is an exploded view of the ink cartridge 10. FIG. 4A is a section view of the ink cartridge 10, and FIG. 4B is an enlarged view of part of the ink cartridge 10. FIG. 4A is a section view through line A-A in FIG. 2A. FIG. 4B is an enlarged view of area B in FIG. 4A.

In some embodiments of the disclosure is described with reference to three mutually perpendicular axes (directions) X, Y, Z. The arrows indicating the directions XYZ in the figures indicate the positive (forward) direction the respective axes, and the direction in the opposite direction as the arrows is the negative (reverse) direction. The vertical axis Z is the vertical axis, and the −Z direction is therefore down on the vertical axis. The three axes XYZ correspond to the orientation of the ink cartridge 10 when installed in the cartridge holder 80 of the inkjet printer 1 shown in FIG. 1, which is also the orientation of the ink cartridge 10 when supplying ink to the inkjet head 4.

As shown in FIG. 2A and FIG. 2B, the ink cartridge 10 has a rectangular cartridge case 12 that is long on the transverse axis X. The cartridge case 12 includes a case body 12*a* and a cover 12*b* (cover member). The case body 12*a* embodies the bottom and sides of the cartridge case 12, and opens to the top (+Z direction). The cover 12*b* is a flat member embodying the top of the cartridge case 12, and closes the top opening in the case body 12*a*.

As shown in FIG. 3, the space inside the cartridge case 12 (see FIG. 2B to FIG. 2D) is divided along the length (on the transverse axis X) of the cartridge case 12 into five parts.

The space at the −X direction end is a waste ink chamber 21 that is part of the waste ink recovery chamber 20, and the other four spaces are the ink chambers 30(1) to 30(4).

The ink chambers 30(1) to 30(4) are on the +X side of the waste ink chamber 21, and are arranged in line to the +X side in the order chamber 30(1), 30(2), 30(3), 30(4). Ink removal units 40(1) to 40(4) (see FIG. 2B and FIG. 4A) for removing ink from the ink chambers 30(1) to 30(4), and a waste ink recovery unit 40(5) for recovering waste ink into the waste ink chamber 21, are formed in the bottom of the case body 12*a*.

The ink chambers 30(1) to 30(4) in the case body 12*a* are shaped like cylindrical vertical (extending on the vertical axis Z) tubes. The case body 12*a* has cylindrical container parts 14(1) to 14(4) including the outside walls surrounding the ink chambers 30(1) to 30(4). The cylindrical container parts 14(1) to 14(4) are disposed in a row on the transverse axis X, and adjacent cylindrical container parts are connected together.

The waste ink chamber 21 is rectangular in section and opens to the top on the vertical axis Z, and the case body 12*a* has a rectangular container part 15 surrounding the waste ink chamber 21. The rectangular container part 15 is connected to cylindrical container part 14(1). The tops of the cylindrical container parts 14(1) to 14(4) and the rectangular container part 15 are also connected to a flat member 16 parallel to the XY plane. The outside edges of the flat member 16 are connected to a frame part 17 that rises on the vertical axis Z.

A flat divider 50 (dividing member) is disposed between the case body 12*a* and cover 12*b*. The divider 50 contacts the flat member 16 from above, and closes the top openings to the cylindrical container parts 14(1) to 14(4). As a result, the tops of the ink chambers 30(1) to 30(4) are closed. A space that extends horizontally (on the transverse axis X) above the ink chambers 30(1) to 30(4) is also formed between the divider 50 and the cover 12*b*. This space is an ink trap 22 (waste ink inflow space) into which ink overflowing from the waste ink chamber 21 enters. The ink trap 22 and waste ink chamber 21 connect at the top of the waste ink chamber 21, and together form an L-shaped waste ink recovery chamber 20. Ink holding members 18, 19 are disposed in the waste ink recovery chamber 20. The ink holding members 18, 19 are textile members or foam sponges, for example. One ink holding member 18 is disposed in the waste ink chamber 21, and the other ink holding member 19 is in the ink trap 22.

The cover 12*b* also has an air vent 60 formed above where the waste ink chamber 21 and ink trap 22 connect. The waste ink recovery chamber 20 opens to the air through this air vent 60.

The ink holding member 19 has an opening 19*a* formed where the ink holding member 19 overlaps the air vent 60. The air vent 60 faces the opening 19*a* and is separated from the ink holding member 19. The ink holding member 19 also has identically shaped openings 19*b* to 19*d* formed in line with the ink chambers 30(1) to 30(4), and an opening 19*e* located above the chamber 30(4), which is at a position separated from the air vent 60.

Ink Chambers

The construction of the ink cartridge 10 is described further below with reference to FIG. 3 and FIG. 4A.

The ink chambers 30(1) to 30(4) are filled with the same color of ink. The ink chambers 30(1) to 30(4) are identically constructed, and the construction of ink chamber 30(4) is therefore described below.

Ink chamber 30(4) is the space inside the cylindrical container part 14(4) described above, and is closed at the top by the divider 50 described above. A coil spring 34 (pressure member) and movable cover 33 are inserted to the cylindrical container part 14(4). The coil spring 34 is disposed between the movable cover 33 and the bottom 14*b* of the cylindrical container part 14(4). The movable cover 33 is pushed up by the coil spring 34.

An ink holding chamber 35 (FIG. 4A) in which ink is stored is formed inside the cylindrical container part 14(4) by the inside wall 14*a* and bottom 14*b* of the cylindrical container part 14(4), and the movable cover 33. Ink in the ink holding chamber 35 is suctioned out from the ink removal unit 40(4) formed in the middle of the bottom 14*b*. A top space 38 (ink chamber head space) of a capacity determined by the position (height) of the movable cover 33 is formed above the movable cover 33 between the movable cover 33 and the divider 50. The top space 38 communicates with the air vent 60 of the cover 12*b* through an air passage 100 formed in the divider 50.

The movable cover 33 can move vertically along the inside wall 14*a* of the cylindrical container part 14(4). The movable cover 33 includes a round top cover part 33*a*, and a cylindrical body 33*b* extending down a specific length from the outside edge of the top cover part 33*a*. Because the body 33*b* has a specific length, the movable cover 33 can be moved smoothly without play in the movable cover 33 and without the body 33*b* jamming against the inside wall 14*a* of the cylindrical container part 14(4). When the ink holding chamber 35 is charged with ink, the ink penetrates the space 37 between the inside wall 14*a* of the cylindrical container part 14(4) and the movable cover 33, and forms an ink meniscus. This space 37 is sized so that the strength of the ink meniscus formed in the space 37 is greater than the ink suction applied to the ink removal unit 40(4).

When the ink holding chamber 35 of the ink chamber 30(4) is filled with ink, the movable cover 33 rises toward the divider 50. More specifically, the movable cover 33 is near the top end of the cylindrical container part 14(4). Because an ink meniscus is formed in the space 37 between the movable cover 33 and the inside wall 14*a* of the cylindrical container part 14(4), the top space 38 between the divider 50 and the movable cover 33, and the ink holding chamber 35, are separated by the movable cover 33. Furthermore, because the movable cover 33 is pushed up by the coil spring 34, a specific negative pressure is constantly held in the ink holding chamber 35. As a result, even when ink suction is not applied to the ink removal unit 40(4), ink from the ink holding chamber 35 cannot leak to the outside through the ink removal unit 40(4).

Because the force of the coil spring 34 pushing up on the movable cover 33 is less than the strength of the ink meniscus and the ink suction applied to the ink removal unit 40(4), the force of the coil spring 34 will not break the ink meniscus and air bubbles will not enter the ink holding chamber 35. As a result, when ink is suctioned from the ink removal unit 40(4), the movable cover 33 moves toward the ink removal unit 40(4) commensurately to the amount of ink removed.

In this example, the upward urging force of the coil spring is set to 5 gf to 15 gf based on the strength of the ink meniscus formed in the space 37.

The inside diameter of the inside wall 14*a* of the cylindrical container part 14(4) in the area near where the inside wall 14*a* joins the bottom 14*b* gradually decreases with proximity to the bottom 14*b*, forming a tapered inside surface 14*d*. As the amount of ink in the ink chamber 30(4) decreases, the movable cover 33 descends to near the bottom of the cylindrical container part 14(4). When the movable cover 33 reaches the tapered inside surface 14*d* of the cylindrical container part 14(4), the space 37 between the movable cover 33 and the tapered inside surface 14*d* decreases as the movable cover 33 continues to descend. As a result, the strength of the ink meniscus formed in the space 37 increases.

The coil spring 34 inside the ink chamber 30(4) is compressed and the upward urging force of the movable cover 33 increases as the movable cover 33 descends, but the strength of the ink meniscus formed in the space 37 also increases. Therefore, the ink meniscus formed in the space 37 breaking can be reliably avoided even when the amount of remaining ink is low, and bubbles can be prevented from entering the ink holding chamber 35 from the top space 38 above the movable cover 33. When the bottom end of the movable cover 33 reaches the bottom end of the tapered inside surface 14*d*, the movable cover 33 settles into the space around the inside circumference, and becomes locked.

Ink Removal Units

The ink removal units 40(1) to 40(4) are identically constructed, and the construction of the ink removal unit 40(4) is therefore described below.

A round opening 41 is formed in the middle of the bottom 14*b* of the cylindrical container part 14(4), and a tubular frame 42 is formed protruding down from the bottom of the cylindrical container part 14(4) around the outside edge of the round opening 41. A disk-shaped rubber seal 43 is fit around the inside of the tubular frame 42, and a through-hole formed in the center of the rubber seal 43 functions as the ink removal orifice 40*b*. Another tubular frame 44 protrudes up from around the outside edge of the round opening 41 on the ink holding chamber 35, and this center opening embodies a valve chamber 45 that connects the ink removal orifice 40*b* and ink holding chamber 35. A valving element 46 that can close the ink removal orifice 40*b* is disposed in the valve chamber 45, and this valving element 46 is pushed by a coil spring 47 against the back of the rubber seal 43, thereby closing the ink removal orifice 40*b*. A pressure member 48 that pushes the rubber seal 43 from below is attached to the distal end of the tubular frame 42.

When an ink cartridge 10 is installed in the cartridge holder 80, the distal end of the ink supply needle 7(4) pushes up against the valving element 46 and is inserted through the ink removal orifice 40*b* into the valve chamber 45. As a result, an ink suction path that opens into the distal end of the ink supply needle 7(4) and the valve chamber 45 are connected, and ink in the ink holding chamber 35 can be supplied to the ink supply needle 7(4) side. Because rubber seal 43 surrounds the outside surface of the ink supply needle 7(4), ink will not leak from around the ink supply needle 7(4).

A filter 49 for removing contamination is attached to the top end of the tubular frame 44 protruding into the ink holding chamber 35. Foreign matter contained in the ink supplied from the ink holding chamber 35 to the ink supply needle 7(4) side can therefore be captured by the filter 49 and prevented from flowing to the inkjet head 4 side.

Divider

The divider 50 is described next with reference to FIG. 5A and FIG. 5B.

Figure 5A:
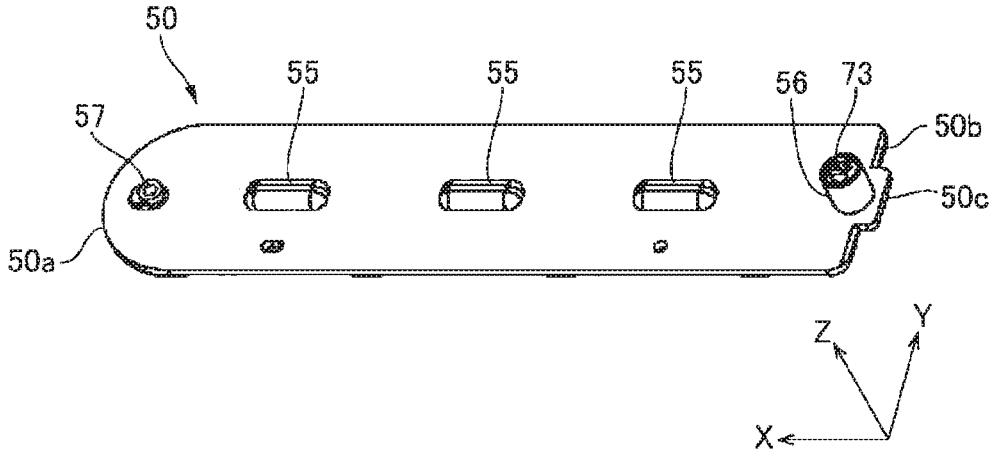
FIG. 5A is an oblique view of the divider in the ink cartridge shown in FIG. 2 from above on the vertical axis Z.
Figure 5B:
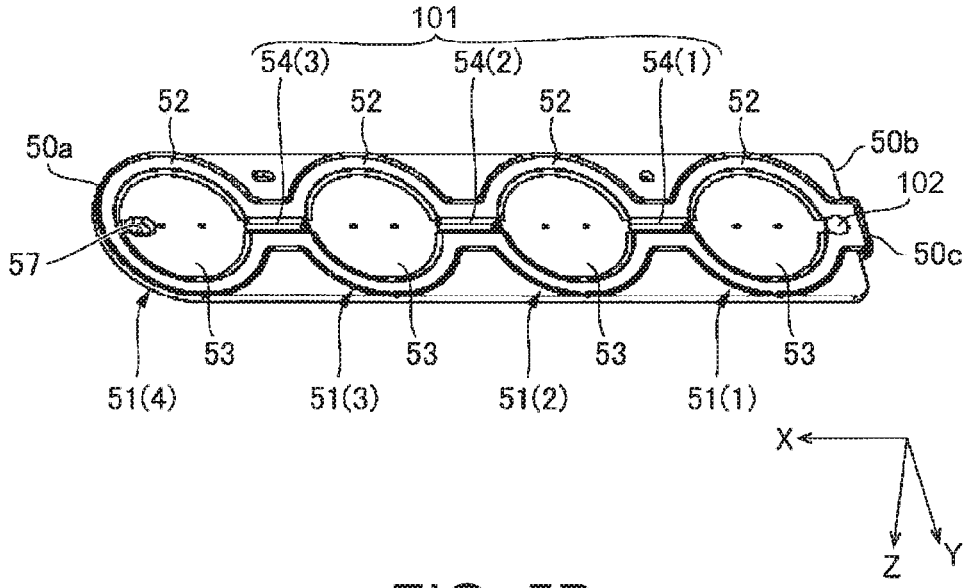
FIG. 5B is an oblique view of the divider in the ink cartridge shown in FIG. 2 from below on the vertical axis Z.

FIG. 5A is an oblique view of the divider 50 from above, and FIG. 5B is an oblique view of the divider 50 from below. As shown in FIG. 5B, cap members 51(1) to 51(4) for capping the ink chambers 30(1) to 30(4) are formed in a line on the back (bottom) side of the divider 50. As shown in FIG. 3, the opening at the top of ink chamber 30(1) has a round edge that connects to the flat member 16 of the case body 12*a*. The cap member 51(1) has an annular ridge 52 forming a circle around the open end of the ink chamber 30(1). A round recess 53 is formed on the inside circumference side of the annular ridge 52. The other cap members 51(2) to 51(4) are identically configured, and each has a annular ridge 52 and round recess 53. These four annular ridges 52 are welded to the flat member 16 in the area around the open end of the ink chambers 30(1) to 30(4). As a result, divider 50 is joined to the flat member 16, and the ink chambers 30(1) to 30(4) are capped by the cap members 51(1) to 51(4).

A channel 54(1) extending on the transverse axis X between is formed between the cap member 51(1) and cap member 51(2). Adjacent round recesses 53 communicate through this channel 54(1). A channel 54(2) extending on the transverse axis X between is also formed between the cap member 51(2) and cap member 51(3), and a channel 54(3) extending on the transverse axis X is also formed between the cap member 51(3) and cap member 51(4). The four round recesses 53 thus communicate through these three channels 54(1)-54(3). The four round recesses 53 are the top end of the top space 38 in each of the ink chambers 30(1) to 30(4). More specifically, these three channels 54(1)-54(3) together embody the ink chamber communication path 101 connecting the four ink chambers 30(1) to 30(4).

As shown in FIG. 5(A), three protrusions 55 are formed on the top of the divider 50. These three protrusions 55 correspond to the three channels 54(1)-54(3) formed in the back of the divider 50. Openings 19*b* to 19*d* are formed in the ink holding member 19 as described above at locations corresponding to these protrusions 55.

The divider 50 has a straight edge 50*b* at one end (transverse axis X) end of the length, and a curved edge 50*a* at the other end. As shown in FIG. 3, the straight edge 50*b* is at the corner where the waste ink chamber 21 and ink trap 22 meet. The curved edge 50*a* is formed at the side where the cap member 51(4) that covers the ink chamber 30(4) farthest from the waste ink chamber 21 is formed. A rectangular tab 50*c* is formed in the middle of the straight edge 50*b* beside a tubular protrusion 56.

The tubular protrusion 56 protrudes from the top of the divider 50 toward the cover 12*b* (+Z direction). The top of the tubular protrusion 56 passes through an opening 19*a* formed in the ink holding member 19, and is inserted to the air vent 60 in the cover 12*b*. An air vent communication passage 102 is formed passing vertically through the tubular protrusion 56. The top end of the air vent communication passage 102 communicates with the air vent 60 in the cover 12*b*, and the bottom end opens into the cap member 51(1) and communicates with the round recess 53 in the cap member 51(1) through a short channel formed in the annular ridge 52. The air vent communication passage 102 therefore connects the air vent 60 and the top space 38 of the ink chamber 30(1).

A waste ink inlet 57 is also formed in the divider 50 at the end on the curved edge 50*a* side. The waste ink inlet 57 is a through-hole passing through the thickness of the divider 50, and communicates with the ink trap 22 and the top space 38 of the ink chamber 30(4). The waste ink inlet 57 faces the opening 19*e* of the ink holding member 19 disposed in the ink trap 22.

This configuration of the divider 50 creates an ink chamber communication path 101 (channels 54(1)-54(3)) through which the top spaces 38 of the four ink chambers 30(1) to 30(4) communicate. The top space 38 of the ink chamber 30(1) located at one end of the ink chambers 30(1) to 30(4) communicates through the air vent communication passage 102 with the air vent 60 in the cover 12*b*, and the top space 38 of the ink chamber 30(4) at the other end communicates with the ink trap 22 through the waste ink inlet 57. In other words, the ink chamber communication path 101 and air vent communication passage 102 together form an air passage 100 connecting the waste ink inlet 57 and air vent 60 through the top spaces 38 of the four ink chambers 30(1) to 30(4).

Air Vent

FIG. 4B is a partial section view of the air vent 60 of the cover 12*b*. As shown in FIG. 3 and FIG. 4B, the air vent 60 includes a bubble trap 110, a channel 61 formed in the top of the cover 12*b* in the rectangular area around the bubble trap 110, and a film 62 welded to the area where the bubble trap 110 and channel 61 are formed. One end of the channel 61 extends outside the film 62, and the other end communicates with the bubble trap 110. Because the channel 61 has multiple loops, the path from the bubble trap 110 to the outside is long. This channel configuration suppresses the loss of moisture from the ink in the ink chambers 30(1) to 30(4) and waste ink recovery chamber 20.

The bubble trap 110 is a recess in the cover 12*b*. An opening 112 passing through the center of the bottom 111 of the bubble trap 110 is formed in the cover 12*b*. The top of the bubble trap 110 is covered by the film 62 described above, and the film 62 is separated from the bottom 111 of the bubble trap 110. The tubular protrusion 56 of the divider 50 is inserted from below to the opening 112, and protrudes into the bubble trap 110. A protrusion 113 is formed on the bottom 111 of the bubble trap 110 around the opening 112. A laminated film 114 is welded to the top of the protrusion 113 and the top of the tubular protrusion 56, and closes the opening 112. A connection channel 103 that connects the air vent communication passage 102 and the bubble trap 110 is formed in the distal end of the tubular protrusion 56.

As described below, bubbles produced by air mixing with the waste ink from the air vent communication passage 102 side may flow into the bubble trap 110. The supply of ink from the air vent communication passage 102 side is interrupted by the bubbles entering the bubble trap 110, and the bubbles therefore contact the laminated film 114 and pop. In other words, the air vent 60 can eliminate any bubbles that may enter together with air in the bubble trap 110. The bubbles are therefore prevented from flowing out in the ink.

Introduction of Waste Ink to the Ink Chamber

Figure 6A:
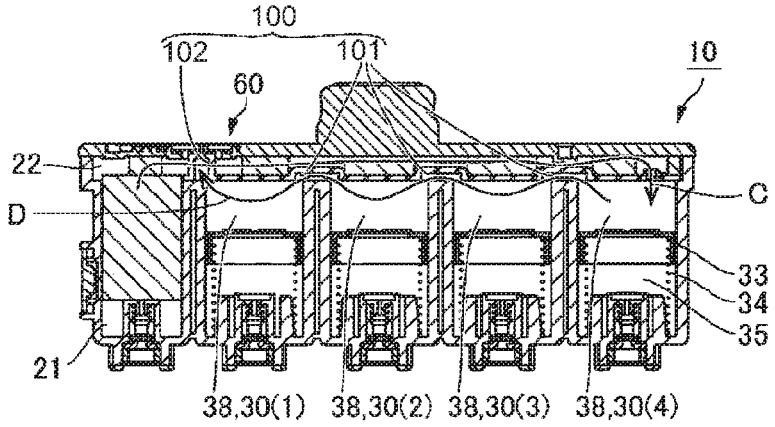
FIG. 6A to FIG. 6D is illustrates the process of introducing recovered waste ink into the ink chamber.

FIG. 6A to FIG. 6D illustrate the process whereby recovered waste ink enters the ink chamber. FIG. 6A shows when the movable cover 33 has descended from the top of the ink chamber as a result of the ink in the four ink chambers 30(1) to 30(4) being used. Note that a top space 38 is formed above each movable cover 33.

As described above, the ink cartridge 10 has a waste ink recovery chamber 20 including the waste ink chamber 21 into which waste ink flows from the inkjet head 4 through the ink recovery needle 7(5), and an ink trap 22 extending above the ink chambers 30(1) to 30(4) and connecting at one end to the waste ink chamber 21. The ink cartridge 10 also has an air passage 100 (ink chamber communication path 101, air vent communication passage 102) that connects the air vent 60 with the waste ink inlet 57 communicating with the ink trap 22 sequentially through the top spaces 38 of the four ink chambers 30(1) to 30(4). As described below, these air passage 100 functions as a waste ink inlet path through which waste ink from the waste ink recovery chamber 20 is introduced to the ink chambers 30(1) to 30(4).

More specifically, as indicated by arrow C in FIG. 6A, when waste ink overflows from the waste ink chamber 21, the waste ink flows through the ink trap 22 into the top of the ink chamber 30(4), and flows from the waste ink inlet 57 into the top space 38 of the ink chamber 30(4). In conjunction therewith, air flows through the top spaces 38 of the ink chambers 30(1) to 30(4) to the air vent 60 as indicated by arrow D in FIG. 6A.

Figure 6B:
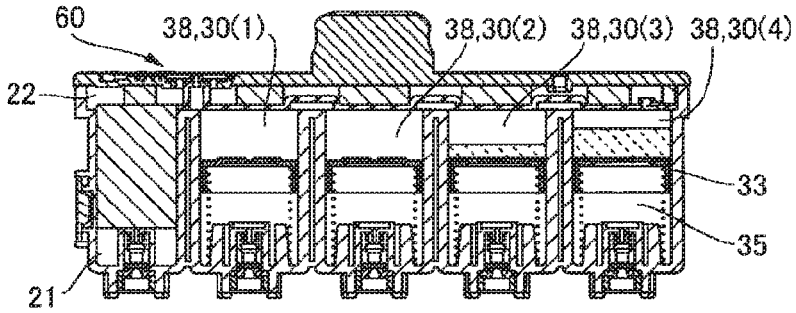

As shown in FIG. 6B, when waste ink overflows from the waste ink inlet 57 into the ink chamber 30(4), the waste ink is held in the top space 38 above the movable cover 33. When waste ink then overflows from the top space 38 of the ink chamber 30(4), the waste ink passes through channel 54(3) of the ink chamber communication path 101, and flows out into the top space 38 of the adjacent ink chamber 30(3). Because the waste ink flows into the top space 38 of the ink chamber 30(4) together with some air held in the ink holding member 19 inside the ink trap 22, the waste ink holds air and is mixed with bubbles. As shown in FIG. 6B, waste ink starts overflowing into the top space 38 of the adjacent ink chamber 30(3) before the top space 38 of the ink chamber 30(4) is completely filled with ink. Waste ink flowing in from the waste ink inlet 57 thus passes through the ink chamber communication path 101 and sequentially into the top space 38 of each ink chamber from ink chamber 30(4) to ink chamber 30(3), ink chamber 30(3), and then ink chamber 30(1).

Figure 6C:
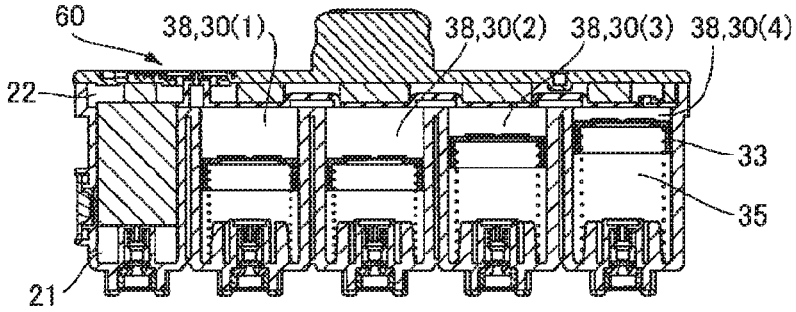

When waste ink flows into the top space 38 of the ink chamber 30(4), the ink meniscus formed in the space 37 between the movable cover 33 and the inside wall 14*a* of the cylindrical container part 14(4) contacts the waste ink and breaks. As a result, because the movable cover 33 is pushed up by the coil spring 34, the waste ink in the top space 38 flows into the ink holding chamber 35 below the movable cover 33, and the movable cover 33 rises. This position is shown in FIG. 6C. More specifically, the ink cartridge 10 is constructed so that waste ink that overflows returns to the ink holding chamber 35.

The ink chambers 30(1) to 30(4) remain in contact with the outside air through the air vent communication passage 102 and air vent 60. Therefore, when waste ink flows from the waste ink inlet 57 into the top spaces 38 of the ink chambers 30(1) to 30(4), air in the top space 38 is pushed to the air vent 60. This air may also contain ink mixed with bubbles. Because the bubble trap 110 causes the bubbles to pop in this event, communication with the outside air is maintained. As a result, waste ink can continue to flow into the ink chambers 30(1) to 30(4).

Figure 6D:
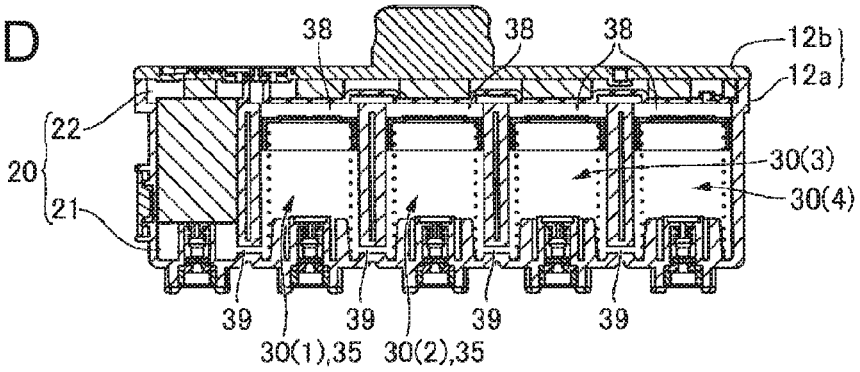

As shown in FIG. 6D, a bottom flow channel 39 that connects the ink holding chambers 35 in adjacent ink chambers may also be formed in the bottoms of the ink chambers 30(1) to 30(4). This enables ink to move between the ink holding chambers 35 through the bottom flow channel 39 when the amount of ink in adjacent ink holding chambers 35 differs to maintain equal internal pressure. As a result, as shown in FIG. 6D, an equal amount of ink can be maintained in the ink chambers 30(1) to 30(4).

As described above, an ink cartridge 10 according to this embodiment has a waste ink inlet 57 that connects the ink chambers 30(1) to 30(4) with the ink trap 22 located thereabove. The waste ink inlet 57 communicates through the ink chambers 30(1) to 30(4) with the air vent 60. As a result, ink overflowing the capacity of the waste ink recovery chamber 20 can flow through the ink trap 22 from the waste ink inlet 57 into the ink chambers 30(1) to 30(4). Needing to replace the ink cartridge 10 because there is insufficient capacity in the waste ink recovery chamber 20 before all ink in the ink chambers 30(1) to 30(4) has been used can therefore be prevented. The ink in the ink chambers 30(1) to 30(4) can therefore be used completely without waste. Furthermore, because the recovered waste ink can be re-used, ink waste is minimal. Increasing the size of the ink cartridge 10 can also be avoided because there is no need to increase the capacity of the waste ink recovery chamber 20 to avoid replacing the ink cartridge 10 due to insufficient capacity in the waste ink recovery chamber 20.

In this embodiments, the plural ink chambers 30(1) to 30(4) are arranged in a single row, a waste ink chamber 21 is provided at one end of this row, and waste ink flows through the ink trap 22 passing the tops of the ink chambers 30(1) to 30(4) into the ink chamber 30(4) that is farthest from the air vent 60. Waste ink then overflows sequentially into the next ink chamber closest to the air vent 60. Finally, waste ink flows into the ink chamber 30(1) that is closest to the air vent 60. Waste ink can therefore be transferred to all of the ink chambers 30(1) to 30(4) as a result of ink flowing in one direction, and air and waste ink can move smoothly through the ink chamber communication path 101.

In this embodiment, air bubbles that enter the ink chambers 30(1) to 30(4) with the waste ink flow through the air passage 100 out to the bubble trap 110 and pop and disappear inside the bubble trap 110. As a result, the air vent 60 becoming clogged by bubbles and air bubbles inhibiting the inflow of ink to the ink chambers 30(1) to 30(4) can be prevented. Bubbles can also be prevented from flowing to the outside, and the cartridge case 12 becoming soiled with ink as a result of ink bubbles popping the moment they reach the outside can be prevented.

Cartridge Holder and Ink Cartridge

Figure 7:
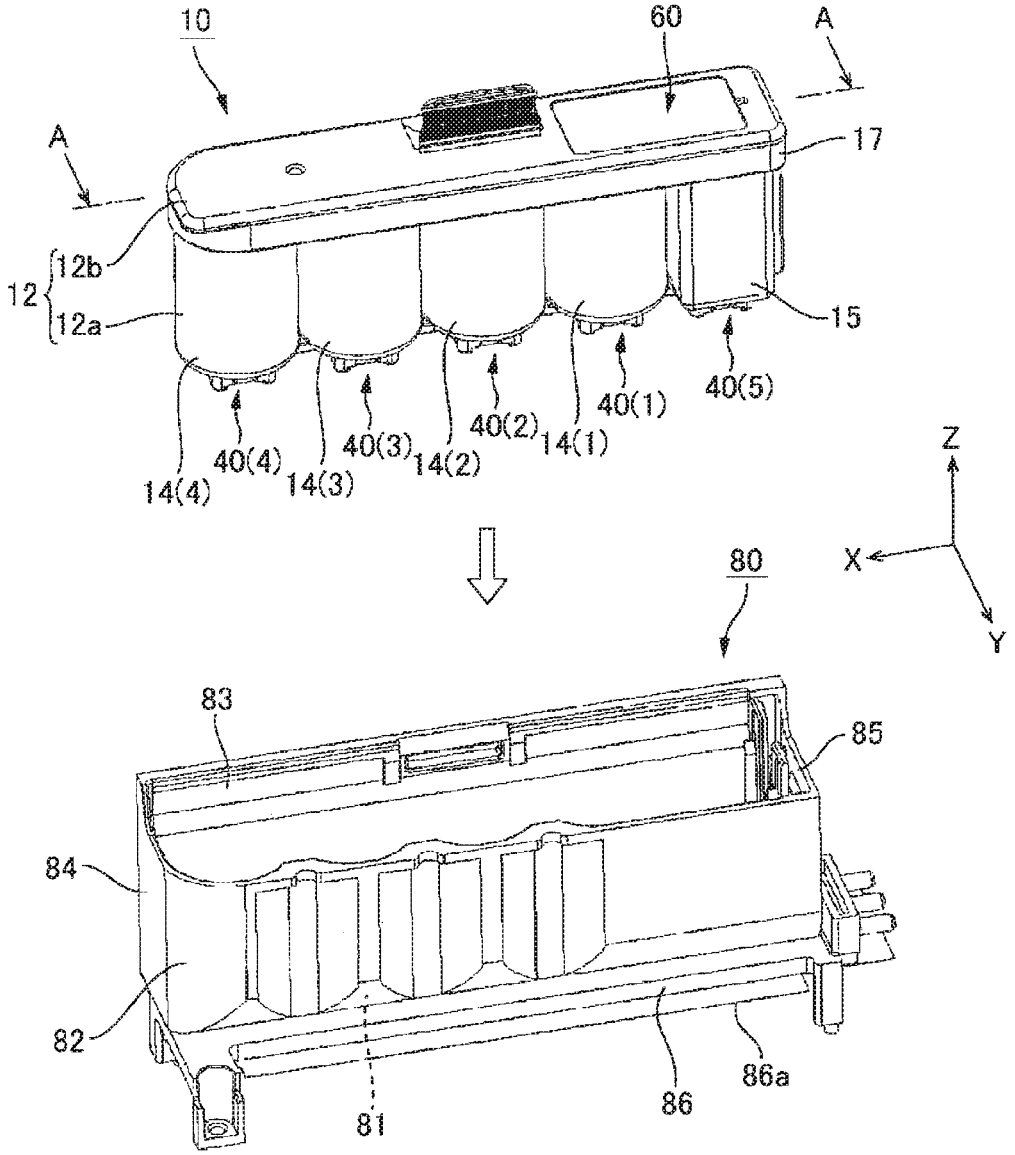
FIG. 7 is an oblique view of the ink cartridge and the cartridge holder.

FIG. 7 is an oblique view of the ink cartridge 10 and cartridge holder 80. In this example, the direction in which an ink cartridge 10 is installed to the cartridge holder 80 is down on the vertical axis Z (−Z direction).

Ink Removal Units of the Cartridge Holder

Figure 8A:
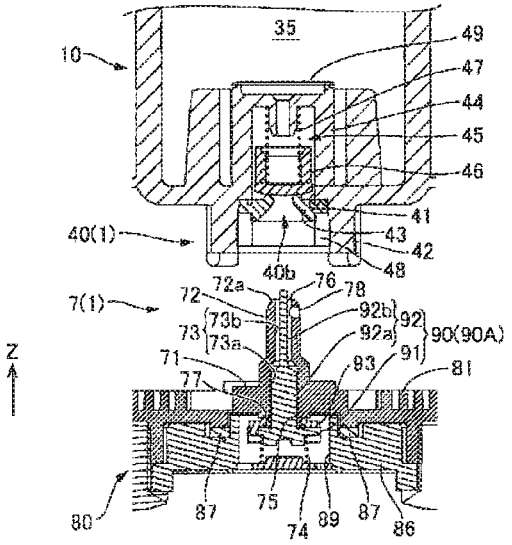
FIG. 8A is a partial section view of the ink cartridge and the cartridge holder.
Figure 8B:
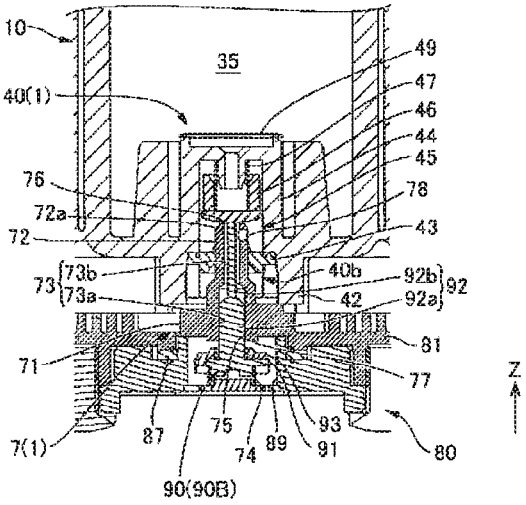
FIG. 8B is a partial section view of the ink cartridge and the cartridge holder.

FIG. 8A and FIG. 8B are partial section views of the ink cartridge 10 and cartridge holder 80, FIG. 8A showing the cartridge holder 80 when the ink cartridge 10 is not installed, and FIG. 8B showing the cartridge holder 80 with the ink cartridge 10 installed. Because the construction of the ink removal units 40(1) to 40(4) is the same, ink removal unit 40(1) is described below. As shown in FIG. 4A, FIG. 8A, and FIG. 8B, a round opening 41 is formed in the middle of the bottom 14*b* of the cylindrical container part 14(1). A tubular frame 42 extends down (−Z axis) from the outside edge of the round opening 41. A round rubber seal 43 is fit inside the tubular frame 42, and a through-hole formed in the center of the rubber seal 43 functions as the ink removal orifice 40*b* (ink supply opening). A tubular frame 44 also protrudes up inside the ink holding chamber 35 from the outside edge of the round opening 41. The space inside the tubular frame 44 is the valve chamber 45 connecting the ink removal orifice 40*b* and the ink holding chamber 35.

A valving element 46 for closing the ink removal orifice 40*b* is disposed inside the valve chamber 45. The valving element 46 is urged down on the vertical axis Z (−Z direction) by a coil spring 47 (second urging member) and pushed against the back of the rubber seal 43, closing the ink removal orifice 40*b*. The pressure member 48 that pushes against the rubber seal 43 from below is disposed to the distal end of the tubular frame 42.

When the ink cartridge 10 is installed to the cartridge holder 80, the valving element 46 is pushed up by the ink supply needle 7(1) of the cartridge holder 80, and the ink supply needle 7(1) is inserted through the ink removal orifice 40*b* to the valve chamber 45 (see FIG. 8B). As a result, ink in the ink holding chamber 35 can be supplied through the valve chamber 45 to the ink supply needle 7(1) side. Foreign matter in the ink supplied from the ink holding chamber 35 to the ink supply needle 7(1) side is trapped at this time by the filter 49 disposed to the top end of the tubular frame 44 to remove foreign matter.

Cartridge Holder

As shown in FIG. 7, the cartridge holder 80 has a basically rectangular bottom 81 that is long on the transverse axis X, a first wall 82 that rises from the +Y axis end of the bottom 81, a second wall 83 that rises from the −Y axis end of the bottom 81, a third wall 84 that rises from the +X axis end of the bottom 81, and a fourth wall 85 that rises from the −X axis end of the bottom 81. The recessed spaced surrounded by these parts is the cartridge holding unit that holds the ink cartridge 10.

As shown in FIG. 1, the ink supply needles 7(1) to 7(4) and the ink recovery needle 7(5) protrude from the bottom 81 of the cartridge holder 80. On the back side of the bottom 81 is a planar flow unit 86 in which a channel that communicates with the ink supply needles 7(1) to 7(4) is formed.

The planar flow unit 86 has a channel embodying a flow path in a flat panel member, and a film 86*a* (FIG. 7) is welded to the planar flow unit 86 to cover this channel. The planar flow unit 86 is fastened by screws to the bottom 81 with a rubber seal 87 (see FIG. 8A and FIG. 8B) between the planar flow unit 86 and the bottom 81. A supply tube 88 (see FIG. 1) is connected to the planar flow unit 86. The ink supply needles 7(1) to 7(4) communicate through the planar flow unit 86 and supply tube 88 with the in-head flow channel of the inkjet head 4.

Ink Supply Needles

The ink supply needles 7(1) to 7(4) are identically constructed, and the construction of the ink supply needle 7(1) is therefore described below.

As shown in FIG. 8A and FIG. 8B, the ink supply needle 7(1) has a seat 71 formed on the bottom 81 of the cartridge holder 80; a needle 72 (tubular part) protruding to the +Z side from the seat 71; an ink path 73 that connects the seat 71 and the needle 72 on the vertical axis Z; a valve member 90 disposed to the ink path 73; and a coil spring 74 (first urging member) that urges the valve member 90 in the +Z direction.

The base end of the needle 72 near the seat 71 is larger in diameter than the distal end. The ink path 73 has a large diameter path 73*a* extending on the vertical axis Z from the bottom of the seat 71 to the large diameter part of the needle 72, and a small diameter path 73*b* extending on the vertical axis Z from the top of the large diameter path 73*a* to the distal end of the needle 72. The large diameter path 73*a* and small diameter path 73*b* are round in section, and extend in a generally straight line. A recess 89 formed in the planar flow unit 86 is disposed on the back side (−Z side) of the seat 71.

The recess 89 is recessed to the −Z direction, and the top end is covered by the seat 71. The bottom end of the large diameter path 73*a* communicates with the recess 89 through an opening 75 formed in the back of the seat 71. The top end of the small diameter path 73*b* communicates with the outside through an opening 76 formed in the distal end 72*a* of the needle 72.

Figure 9:
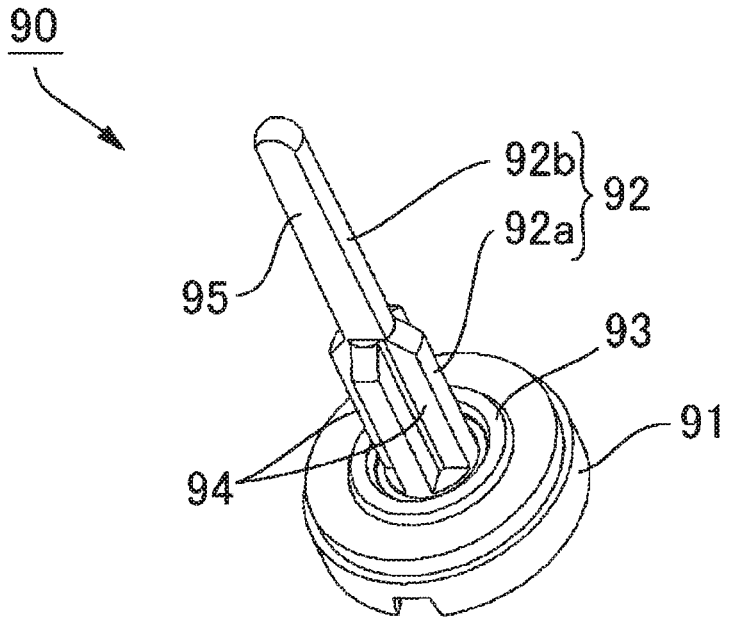
FIG. 9 is an oblique view of the valve member.
Figure 10A:
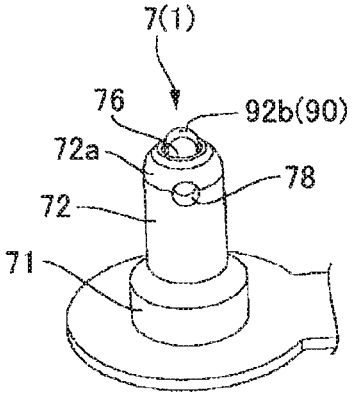
FIG. 10A is an oblique view of the ink supply needle from the distal end of the needle.

FIG. 9 is an oblique view of the valve member 90. FIG. 10A is an oblique view of the ink supply needle 7(1) from the distal end side. As shown in FIG. 8A, FIG. 8B, and FIG. 9, the valve member 90 includes a round seal member 91 disposed in the recess 89, and a stem 92 protruding in the +Z direction from the center of the seal member 91. The coil spring 74 is disposed between the bottom of the recess 89 and the seal member 91. The stem 92 has a large diameter part 92*a* that is inserted to the large diameter path 73*a*, and a small diameter part 92*b* that extends coaxially from the distal end of the large diameter part 92*a* and is inserted to the small diameter path 73*b*.

When the stem 92 is inserted to the ink path 73, the outside circumferential surface of the stem 92 slides against the inside surface of the ink path 73. A plurality of flow channels 94 are formed extending on the vertical axis Z on the outside of the large diameter part 92*a*. Part of the outside surface of the small diameter part 92*b* is a flat member 95 extending on the vertical axis Z. Therefore, space into which ink flows is maintained between the flow channels 94 and the inside surface of the large diameter path 73*a* when the stem 92 is inserted to the ink path 73. Space for ink to flow is also assured between the flat member 95 and the inside surface of the small diameter path 73*b*.

A valve seat 77 is formed as an annular ring around the opening 75 on the back side of the seat 71 of the ink supply needle 7(1).

The seal member 91 of the valve member 90 has an annular seal portion 93 opposite the valve seat 77 on the vertical axis Z.

The valve member 90 in this embodiment is manufactured, for example, from two types of resin materials, an elastomer embodying the annular seal portion 93, and a plastic forming the other parts.

The valve member 90 can move between a closed position 90A (see FIG. 8A) where the annular seal portion 93 contacts the valve seat 77 and seals the ink path 73, and an open position 90B (FIG. 8B) where the annular seal portion 93 is separated from the valve seat 77 and does not seal the ink path 73.

The coil spring 74 urges the valve member 90 from the open position 90B to the closed position 90A (+Z direction). The urging force of the coil spring 74 is set so that the annular seal portion 93 does not separate from the valve seat 77 due to vibration when transporting the inkjet printer 1. When the valve member 90 is in the closed position 90A, the distal end of the small diameter part 92*b* of the valve member 90 protrudes in the +Z direction from the opening 76 in the needle 72. When in the open position 90B, the distal end of the small diameter part 92*b* is pushed inside the small diameter path 73*b* and does not protrude from the opening 76.

Valve Member Operation

As shown in FIG. 8A, the valve member 90 disposed in the ink path 73 is pushed to the closed position 90A by the urging force of the coil spring 74 before the ink cartridge 10 is installed. When the ink cartridge 10 is then inserted from above to the cartridge holder 80, the ink removal unit 40(1) of the ink cartridge 10 is opposite the ink supply needle 7(1). The distal end of the small diameter part 92*b* protruding from the distal end of the needle 72 of the ink supply needle 7(1) is inserted to the tubular frame 42 of the ink removal unit 40(1), and contacts the valving element 46 sealing the ink removal orifice 40*b*.

The valving element 46 on the ink cartridge 10 side is urged down (−Z direction) by coil spring 47, and the valve member 90 with the small diameter part 92*b* is urged up (+Z direction) by coil spring 74. The urging direction of the coil spring 47 is thus opposite the urging direction of the coil spring 74. The urging force of the coil spring 47 in this embodiment is greater than the urging force of the coil spring 74.

For example, the spring load of the coil spring 47 is set to approximately nine times the spring load of the coil spring 74. When the ink cartridge 10 is pushed further down (−Z direction) after the distal end of the small diameter part 92*b* contacts the valving element 46, the small diameter part 92*b* is pushed by the valving element 46 into the opening 76 in the needle 72 until the valving element 46 is pushed against the rubber seal 43. As a result, the valve member 90 is pushed from the closed position 90A to the open position 90B, and the ink path 73 inside the ink supply needle 7(1) communicates with the path inside the planar flow unit 86.

When the valve member 90 is pushed down to the open position 90B, the valving element 46 contacts the distal end 72*a* of the needle 72. When the ink cartridge 10 is then pushed further down, the distal end 72*a* of the needle 72 pushes up on the valving element 46 inside the valve chamber 45, and is inserted through the ink removal orifice 40*b* to the valve chamber 45. The ink cartridge 10, as shown in FIG. 8B, is pushed inside the cartridge holder 80 until it meets the bottom 81 of the cartridge holder 80. The needle 72 of the ink supply needle 7(1) has a through-hole 78 (see FIG. 8A, FIG. 8B, FIG. 10A) that passes radially through the tubular portion surrounding the small diameter path 73*b* at a position near the distal end 72*a*.

As shown in FIG. 8B, the ink supply needle 7(1) is inserted until this through-hole 78 opens into the valve chamber 45. The ink path 73 therefore communicates through the through-hole 78 with the valve chamber 45. The rubber seal 43 disposed to the ink removal orifice 40*b* is also sealed against the outside circumference surface of the ink supply needle 7(1) inserted to the valve chamber 45. Ink is therefore prevented from leaking from around the ink supply needle 7(1).

To remove the ink cartridge 10 installed in the cartridge holder 80, the ink cartridge 10 is lifted up (+Z direction) from the position shown in FIG. 8B, pulling the ink supply needle 7(1) from the ink removal orifice 40*b*. The valving element 46 remains pushed down against the distal end 72*a* of the needle 72 by the urging force of the coil spring 47 at this time. The valving element 46 stops at a position pressed against the back of the rubber seal 43, and returns the ink removal orifice 40*b* to the closed state. Until the ink removal orifice 40*b* is sealed by the valving element 46, the ink supply needle 7(1) remains with the valve member 90 held at the open position 90B by the valving element 46. When the ink cartridge 10 then rises further on the +Z direction, the valving element 46 separates from the distal end of the ink supply needle 7(1), and the stem 92 is released from being pushed by the valving element 46. As a result, the urging force of the coil spring 74 returns the valve member 90 to the closed position 90A shown in FIG. 8A.

Figure 10B:
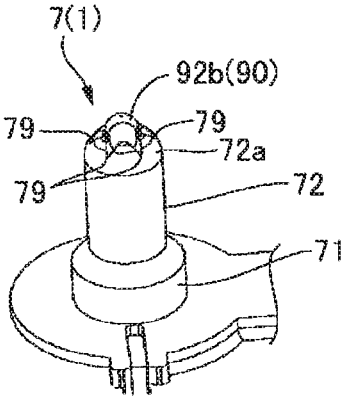
FIG. 10B is an oblique view of the ink supply needle of a different shape from the distal end of the needle.

FIG. 10B is an oblique view showing another example of the distal end shape of the ink supply needle 7(1).

As shown in FIG. 10B, the ink supply needle 7(1) may have a channel 79 formed in the distal end 72*a* of the seat 71. When forming the channel 79, the through-hole 78 shown in FIG. 10A may be omitted. This channel 79 extends radially to the outside from the edge of the opening 76 in the distal end 72*a*. When the valving element 46 is in contact with the distal end 72*a* of the needle 72, the channel 79 connects the ink path 73 to the outside without being obstructed by the valving element 46. Therefore, the ink path 73 and valve chamber 45 communicate through the channel 79 when the ink cartridge 10 is installed in the cartridge holder 80. Note that the channel 79 shown in FIG. 10B is V-shaped in section, but is not so limited and may have any sectional shape that is not obstructed by the valving element 46 in contact with the distal end 72*a*.

As described above, a valve member 90 including a seal member 91 and a stem 92 is disposed to each of the ink supply needles 7(1) to 7(4) that are disposed to the cartridge holder 80 of the inkjet printer 1. The valve member 90 closes the ink path 73 of the ink supply needle 7(1) to 7(4) with the seal member 91, and is urged by the coil spring 74 to the closed position 90A where the stem 92 protrudes from the opening 76 formed in the distal end 72*a* of the ink supply needle 7(1) to 7(4). Therefore, when an ink cartridge 10 is installed in the cartridge holder 80, the valve member 90 is set to the closed position 90A by the coil spring 74, and the ink path 73 is kept closed by the seal member 91. Ink is therefore prevented from leaking from the ink supply needles 7(1) to 7(4) when an ink cartridge 10 is not installed in the cartridge holder 80 and the inkjet printer 1 is vibrated or shaken during shipping, for example.

Because the stem 92 is incorporated in the ink path 73 in this embodiment, the volume from the opening 75 capped by the seal member 91 to the opening 76 formed in the distal end 72*a* is small. Therefore, even if ink held in the space from the seal member 91 to the opening 76 leaks from the opening 76, the amount is small. Soiling of the inside of the inkjet printer 1 by leaked ink is therefore minimal. In addition, the chance of the inkjet printer 1 becoming unusable because ink leaks to the circuit board, for example, is extremely small.

Furthermore, when an ink cartridge 10 is installed in the cartridge holder 80 in this embodiment, a construction (valving element 46) on the ink cartridge 10 applies pressure to the stem 92 and can move the valve member 90 to the open position 90B where the ink path 73 is not blocked by the seal member 91. Because the valve of the ink path 73 is forcibly opened by contact with a member on the ink cartridge 10, an actuator such as a control valve does not need to be used to drive the valve member 90. The ink path 73 can therefore be reliably closed when the ink cartridge 10 is not installed, and the ink path 73 can be reliably opened when the ink cartridge 10 is installed, by a simple configuration. Because movement of the valve member 90 can be kept within the manufacturing variance of the parts with this configuration, change in the flow resistance of the ink path 73 where the valve member 90 is disposed is small. As a result, there is little change in the back pressure when ejecting ink from the inkjet head 4, and ink can be discharged consistently.

When installing an ink cartridge 10 in this embodiment, the valve (valve member 90) on the ink supply needles 7(1) to 7(4) side opens first, the gap between the ink supply needles 7(1) to 7(4) and ink removal orifice 40*b* is then sealed by the rubber seal 43 disposed to the ink removal orifice 40*b*, and the valve (valving element 46) on the ink cartridge 10 side opens. Ink can therefore be prevented from leaking from the ink cartridge 10 when the ink supply needles 7(1) to 7(4) and ink removal orifice 40*b* connect. This operation can be achieved by appropriately setting the relationship between the coil spring 74 that urges the valve member 90 and the urging force of the coil spring 47 that urges the valving element 46. Ink in the ink cartridge 10 can therefore be reliably prevented from leaking.

In this embodiment, a through-hole 78 passing radially through the needle 72 is formed in the tubular needle 72 inside of which the ink path 73 is formed, or a channel 79 extending from the edge of the opening 76 to the outside is formed in the distal end 72*a* of the needle 72. As a result, when the distal end 72*a* of the needle 72 contacts the valving element 46 on the ink cartridge 10 side, a state in which the valve chamber 45 and the ink path 73 do not communicate cannot be avoided. When an ink cartridge 10 is installed, ink in the ink cartridge 10 can therefore be reliably suctioned from the ink cartridge 10 by the ink supply needles 7(1) to 7(4).

Other Embodiments

Figure 11:
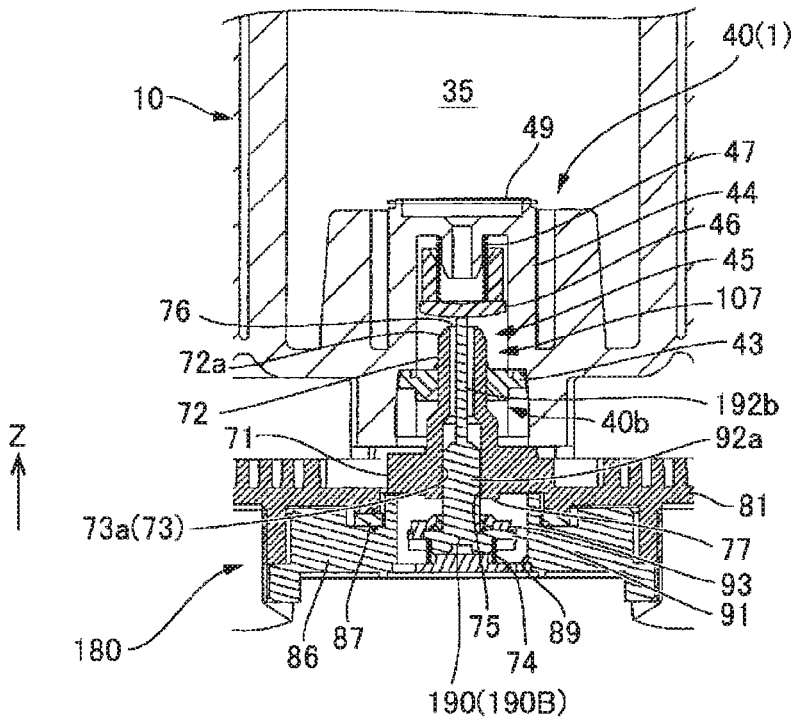
FIG. 11 is a partial section view of a cartridge holder with an ink supply needle according to another embodiment.

FIG. 11 is a partial section view of a cartridge holder 180 with an ink supply needle 107 according to another embodiment, and shows the ink cartridge 10 installed. Like parts in this and the foregoing embodiment are identified by like reference numerals, and further description thereof is omitted or simplified.

The ink supply needle 107 in this embodiment has a valve member 190 with a small diameter part 192*b* that is longer than the small diameter part 92*b* in the foregoing embodiment installed in the ink path 73. This valve member 190 moves between the open position 190B shown in FIG. 11 and the closed position (not shown in the figure) where the seal member 91 is touching the valve seat 77.

When the ink cartridge 10 is installed to the cartridge holder 180, the valve member 190 is pushed by the valving element 46, and stops at the open position 190B with the seal member 91 touching the bottom of the recess 89. The valve member 190 has a small diameter part 192*b* that is longer than the small diameter part 92*b* in the foregoing embodiment. The length of the small diameter part 192*b* is set so that when the valve member 190 moves from the closed position (not shown in the figure) to the open position 190B, the small diameter part 192*b* is pushed into the opening 76 and protrudes a small amount from the opening 76, but also protrudes from the opening 76 slightly in the open position 190B. Because the opening 76 is separated from the valving element 46 when the ink cartridge 10 is installed to the cartridge holder 180 in this embodiment, the opening 76 will not be blocked by the valving element 46. The ink path 73 and valve chamber 45 can therefore communicate without forming a through-hole 78 or channel 79 as in the foregoing embodiment.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An ink cartridge comprising:

a case with an air vent; and a divider configured to divide at least part of the space inside the case into an ink chamber and a waste ink recovery chamber, the divider having a waste ink inlet connecting the ink chamber and the waste ink recovery chamber, and an air passage connecting the waste ink inlet to the air vent through the ink chamber, wherein:

the case has a plurality of ink chambers arranged in a row, the divider has a plurality of can members configured to can the plurality of ink chambers, the air passage includes an ink chamber communication path connecting adjacent ink chambers at the ink chamber side of the divider, and an air vent communication passage connecting the ink chamber, among the plurality of ink chambers, at one end of the row and the air vent, and the waste ink inlet is formed in the cap member, among the plurality of cap members, at the other end of the row.

2. The ink cartridge described in claim 1, wherein:

the divider configured to divide part of the space inside the case vertically;

the ink chamber is located below the divider;

the waste ink recovery chamber has a waste ink inflow space above the divider, and a waste ink chamber located beside the ink chamber; and the top of the waste ink chamber is connected to the waste ink inflow space.

3. The ink cartridge described in claim 1, further comprising:

a bottom flow channel fluidly connecting the bottom parts of adjacent ink cartridges.

4. The ink cartridge described in claim 1, further comprising:

a movable cover configured to divide the ink cartridge into an ink chamber head space and an ink holding chamber therebelow; and a pressure member configured to push the movable cover to the ink chamber head space side with less force than the surface tension of the ink meniscus formed between the inside circumference surface of the ink chamber and the outside circumference surface of the movable cover.

5. The ink cartridge described in claim 4, wherein:

the case includes a case body in which the ink chamber and waste ink recovery chamber are formed, and a cover member configured to close the opening to the case body and having the air vent formed therein; and the air passage has a bubble trap connected to the air vent, and a channel connecting the bubble trap to the outside.

6. The ink cartridge described in claim 5, wherein:

an opening is formed in the bottom of the bubble trap;

the divider has a tubular protrusion protruding into the opening in the bubble trap; and the air vent communicates with the bubble trap through the inside of the tubular protrusion.

7. An inkjet printer comprising:

a printhead; and a cartridge holder in which an ink cartridge configured to supply ink to the printhead is installed, and which has an ink supply needle in which an ink path is formed;

the ink supply needle having a valve member with a stem disposed in the ink path, and a seal member configured to open and close the ink path, and a first urging member configured to urge the valve member toward the distal end of the ink supply needle;

wherein the valve member moves between a closed position where the seal member closes the ink path and the stem protrudes from the opening in the distal end of the ink supply needle, and an open position where the ink path is not closed by the seal member.

8. The inkjet printer described in claim 7, wherein:

the stem does not protrude from the opening in the open position.

9. The inkjet printer described in claim 8, wherein:

the stem is pushed by the valving element closing the ink supply opening of the ink cartridge, the valve member moves to the open position, and the ink supply needle is then inserted to the ink supply opening when the ink cartridge is installed in the cartridge holder; and when the ink cartridge is removed from the cartridge holder, the ink supply needle is pulled out from the ink supply opening, the valving element returns to the position closing the ink supply opening, and the valve member then returns to the closed position by the urging force of the first urging member.

10. The inkjet printer described in claim 9, wherein:

the first urging member urges the valve member with less urging force than the urging force of a second urging member configured to urge the valving element to the side closing the ink supply opening.

11. The inkjet printer described in claim 10, wherein:

the urging direction of the valve member by the first urging member is opposite the urging direction of the valving element by the second urging member.

12. The inkjet printer described in claim 7, wherein:

the ink supply needle has a tubular part in which the ink path is formed, and a through-hole passing through the tubular part.

13. The inkjet printer described in claim 7, wherein:

the ink supply needle has a channel extending from the edge of the opening to the outside circumference side.

14. The inkjet printer described in claim 7, wherein:

a flow path extending axially to the stem is formed in the outside circumference surface of the stem.

* * * * *